United States Patent [19]

Palvadeau et al.

[11] Patent Number: 4,601,805

[45] Date of Patent: Jul. 22, 1986

[54] APPARATUS FOR PREPARING METAL BY ELECTROLYSIS

[75] Inventors: Claude Palvadeau, Breuillet; Claude Scheidt, Issy-les-Moulineaux, both of France

[73] Assignee: Societe Miniere et Metallurgique de Penarroya, Paris, France

[21] Appl. No.: 674,668

[22] Filed: Nov. 26, 1984

Related U.S. Application Data

[62] Division of Ser. No. 492,443, May 6, 1983, Pat. No. 4,507,182.

[30] Foreign Application Priority Data

May 6, 1982 [FR] France ..... 82 07940

[51] Int. Cl.[4] ..... C25C 7/08; C25B 11/10; C25B 11/12

[52] U.S. Cl. ..... 204/255; 204/266; 204/290 F; 204/292; 204/294; 204/263

[58] Field of Search ..... 204/117, 255-256, 204/263, 273, 237, 292-294, 268, 290 F

[56] References Cited

U.S. PATENT DOCUMENTS

| | | | |
|---|---|---|---|
| 1,051,060 | 1/1913 | Balke | 204/268 |
| 1,312,756 | 8/1919 | Stover | 204/268 |
| 1,448,923 | 3/1923 | Flynn et al. | 204/117 |
| 3,577,334 | 5/1971 | Graham et al. | 204/263 X |
| 4,107,006 | 8/1978 | Winand | 204/255 X |
| 4,196,059 | 4/1980 | Petrov et al. | 204/263 X |
| 4,312,724 | 1/1982 | Kammel et al. | 204/117 |
| 4,492,621 | 1/1985 | Stubb | 204/273 X |

*Primary Examiner*—Donald R. Valentine

*Attorney, Agent, or Firm*—Fleit, Jacobson, Cohn & Price

[57] ABSTRACT

The present invention is directed to an apparatus for preparing a lead or copper metal by electrolysis in a cell having a cathode and an anode which are separated by a diaphragm. The surface of the cathode is arranged in a substantially vertical direction and has a sufficiently low density of sites of nucleation so that metallic particles which are formed from the sites keep their individuality in relation to the adjacent particles, until the particles reach a dimension of at least 100 micrometers. An electrolyte is circulated between the cathode and an anode parallel to the surface of the cathode at a flow rate in a laminar to weakly turbulent manner so that under the action of the weight of the particles and the force exercised by the flow of the electrolyte the metallic particles are detached and fall into the electrolyte and are collected and are removed from the bottom of the cell.

22 Claims, 7 Drawing Figures

APPARATUS FOR PREPARING METAL BY ELECTROLYSIS

This is a divisional of application Ser. No. 492,443 filed May 6, 1983, now U.S. Pat. No. 4,507,182.

BACKGROUND OF THE INVENTION

The present invention concerns the preparation of a metal by electrolysis, and especially the preparation of lead by metallic chloride. It concerns in particular the electrolysis of very pure solutions of lead chloride.

The processes currently used for metallurgical treatment of lead ores permit the preparation of solutions of lead chloride which are very pure, for example, after purification by a solvent or crystallization. The invention concerns the preparation of the lead by such solutions.

French Pat. No. 73-30.657 describes a process for deposit of metallic lead by aqueous solutions of lead chloride. More specifically this patent describes the electrolysis of such a solution in a cell with a diaphragm, in the presence of ferrous chloride which oxidizes into ferric chloride during the operation; in example 1 of this patent, the concentration of the lead in the electrolyte is reduced to a value between 25 and 11 grams per liter, in a 3M solution in ferrous chloride, with a current density of 323 $A/m^2$ and a faradic return of 70%. The patent does not indicate the properties of the deposit of metallic lead such as its DENSITY, its adherence to the cathodic support (leaf of lead), its compact nature, or dusty nature, or its purity, nor the method of extraction of the lead.

The work "Electrometallurgy of Chloride Solutions" cf V. V. Stender, Consultants Bureau, New York (1965) indicates that a deposit of lead, non compact, with gross crystallization, having a metallic appearance, can be obtained from a concentrated brine of sodium chloride containing lead. The concentration of the lead decreases from 40 to 10 grams per liter in the course of an electrolysis carried out with a current density between 500 and 1,000 $A/m^2$. The work does not give precise information on the properties of the lead such as its purity, its density, its adherence to the cathode which is composed of a leaf of lead, nor on the method of extraction of the deposit. The faradic return obtained would be between 85 and 90%. The same work indicates that a powder of lead can be obtained from solutions containing 300 grams per liter of NaCl and 10 grams per liter of lead in the form of chloride, with a faradic return of approximately 80%.

The report "Aqueous electrolysis of lead chloride" by F. P. Haver, D. L. Bixby and M. M. Wong, U.S. B.M. Report of Investigations, 8276 (1978) described the electrolysis of lead chloride, crystallized on a horizontal cathode placed at the bottom of the cell, so that the concentration of lead in solution remains constant. This document indicates that, as soon as the last crystal of lead chloride disappears, the deposit becomes spongy, with a non-metallic appearance and sticky appearance. In the presence of crystals, the faradic return obtained is 96% for a current density of 150 $A/m^2$, in a solution of 20% HCl at 25° C.

French Pat. No. 70-12.867 describes a process of extracting lead from sulphurated ores. This process assures the regeneration of the reagent, the ferric chloride, to the anode of an electrolyser having neither diaphragm nor membrane. The lead is deposited on a cathode formed from an assemblage of shafts mounted in special supports so that shocks can be applied to the shafts from the rotation of these or their mounting setup. The lead formed detaches itself under the action of the shocks and falls to the bottom of the vat. It is then removed. This patent does not describe the effects of the electrolysis current in the neighborhood of the electrode and describes neither the recovery of the lead fragments nor the treatment of the lead before fusion.

French Pat. No. 2.386.349 describes a process and an apparatus for recovery of metallic particles by electrolysis. This patent concerns essentially copper and secondarily transition metals, those which are indicated as preferable being two of the groups VII, **1*b* and 2*b***, of the Periodic Classification of the Elements. This patent thus does not concern the treatment of lead. According to this patent, the metal, essentially copper, forms, on the cathodes, particles which are removed by use of vigorous rubbing done by mechanical agitators placed in front of the cathodes. According to an essential characteristic of the process described in this patent, the powder must undergo washing before being removed from the electrolysis cell.

Thus, the processes described have some drawbacks and the documents mentioned above possess certain gaps. In particular, it is not known what is the quality of the powder obtained, particularly its purity, its density, its properties of oxidation by the air, all of which are essential properties in the industrial exploitation of such a powder.

These documents, except the last one cited, do not indicate any process of extraction of the lead formed capable of being used in an industrial electrolyser.

The faradic returns obtained are most often lower than 90%. The anodic reaction is not described in general and it is not indicated if the chlorine disengages itself from the anode or if on the contrary this disengagement is avoided, and in what manner.

OBJECTS OF THE INVENTION

The invention concerns the preparation by electrolysis of a metal present in the electrolyte under a non-cationic and especially anionic form.

It concerns such a process which applies a continuous removal of the metal which is formed on the cathodes.

It concerns such a process which permits the preparation of a particular metal, especially lead specifically which is not pyrophoric and which can be easily turned into an economically profitable by-product.

It concerns also such a process which permits a very high faradic return.

SUMMARY OF THE INVENTION

According to the invention, the electrolyte circulates parallel to the cathodes which are placed vertically with a speed such that its flowing is of a laminary type or weakly turbulent, so that this current, in cooperation with the apparent weight of the particles, ensures the removal of these from the cathodes and, simultaneously, the renewal of the electrolyte next to the surfaces of the electrodes.

More specifically, the invention concerns a process of preparation of a metal, preferably of lead, by electrolysis in a cell with a diaphragm, of the type which includes the formation of an electrolyte containing a metal chloride to be prepared and an alkali or an alkaline-earth metal chloride, and the circulation of the electrolyte between the electrodes and parallel to the surface of the cathodes. According to the invention, the cathodic surface is arranged in a mainly vertical direction and has a density sufficiently low in sites of nucleation so that the metallic particles which are formed from these sites keep their individuality vis-a-vis the adjacent particles, until they reach a dimension of at least 100 micrometers; the flowing of the electrolyte the length of the cathodic surface is of a laminar type of weakly turbulent type, so that, under the action of their weight and of the forces attracting them exercised by the electrolyte current, the metal particles detach themselves and fall into the electrolyte; the process includes in addition the removal of the metallic particles gathered together at the bottom of the cell.

When the metal of the electrolysis is lead, it is present, in the form of chloride, in a quantity between approximately 5 and 50 grams per liter, preferably between 15 and 25 grams per liter in the electrolyte.

Chloride of alkali metal or earth-alkali metal is preferably sodium chloride. Its concentration in the electrolyte is preferably between 230 and 300 grams per liter.

In the course of the electrolysis, the density of the current of electrolysis is between 500 and 1,500 $A/m^2$, preferably between 700 and 1,000 $A/m^2$. It is preferable that this density of current increase progressively from the beginning of the electrolysis.

During the electrolysis, the temperature of the electrolyte is beneficially between 70° and 95° C.

The cathodic surface having a low density of sites of nucleation is preferably formed of titanium, of stainless steel, or of graphite.

It is advantageous that the electrolyte contain also some iron under the form of chloride. The concentration of the iron is then advantageously higher than 10 grams per liter and preferably between 20 and 60 grams per liter.

The flowing of laminary type or weakly turbulent type of the electrolyte the length of the cathodic surface is obtained when the current of the electrolyte circulates around the cathodes at a speed between 0.01 and 0.15 meters per second.

The removal of the particles gathered at the bottom of the cell is advantageously done by moving the particles out of the cell, then by densification of the particles by compression. In addition, the thickened particles can undergo a lamination designed to expel the inclusions of electrolyte. The thickened particles can also undergo a fusion in the presence of solder.

The invention also concerns an apparatus for preparing a metal by electrolysis, specifically lead, in which the cathodes and the anodes are arranged vertically. According to the invention, the cathodes are formed of a material chosen from the group which includes titanium, stainless steel and graphite, and the apparatus includes at least one pump designed to circulate a current of electrolyte of laminary or weakly turbulent type the length of the cathodes, and a transport mechanism designed to withdraw the solid, divided material which can fall to the bottom of the cell.

In one manner of advantageous application of the invention, the electrodes are bipolar.

The device includes advantageously a recovery hood when gaseous chloride separates from the anodes.

The anodes are advantageously formed of a metal which cannot be attacked by the electrolyte and in a spread-out form.

The transport device can be advantageously an endless screw, an elevator of cups, or a transporting roller and preferably the gooseneck system described below.

The device can also include an extruder designed to receive the particles extracted and to compact and densify them.

The invention concerns also a by-product of lead, prepared by the previously mentioned process and containing less than 0.2% of electrolyte in the form of inclusions.

The process and the apparatus according to the invention have all the advantages of apparatus in which the metal removes itself automatically from the cathodes. The main advantage is the almost total elimination of manipulation of the electrodes. This reduction in manipulation increases the time of useful service of the electrolysers so much that the number of electrolysis cells can be reduced, with corresponding reduction in investment.

In addition, thanks to the very high faradic return ensured by the invention, higher than 90%, and often 95% of the energy losses are reduced.

PREFERRED EMBODIMENTS

Figure 1:
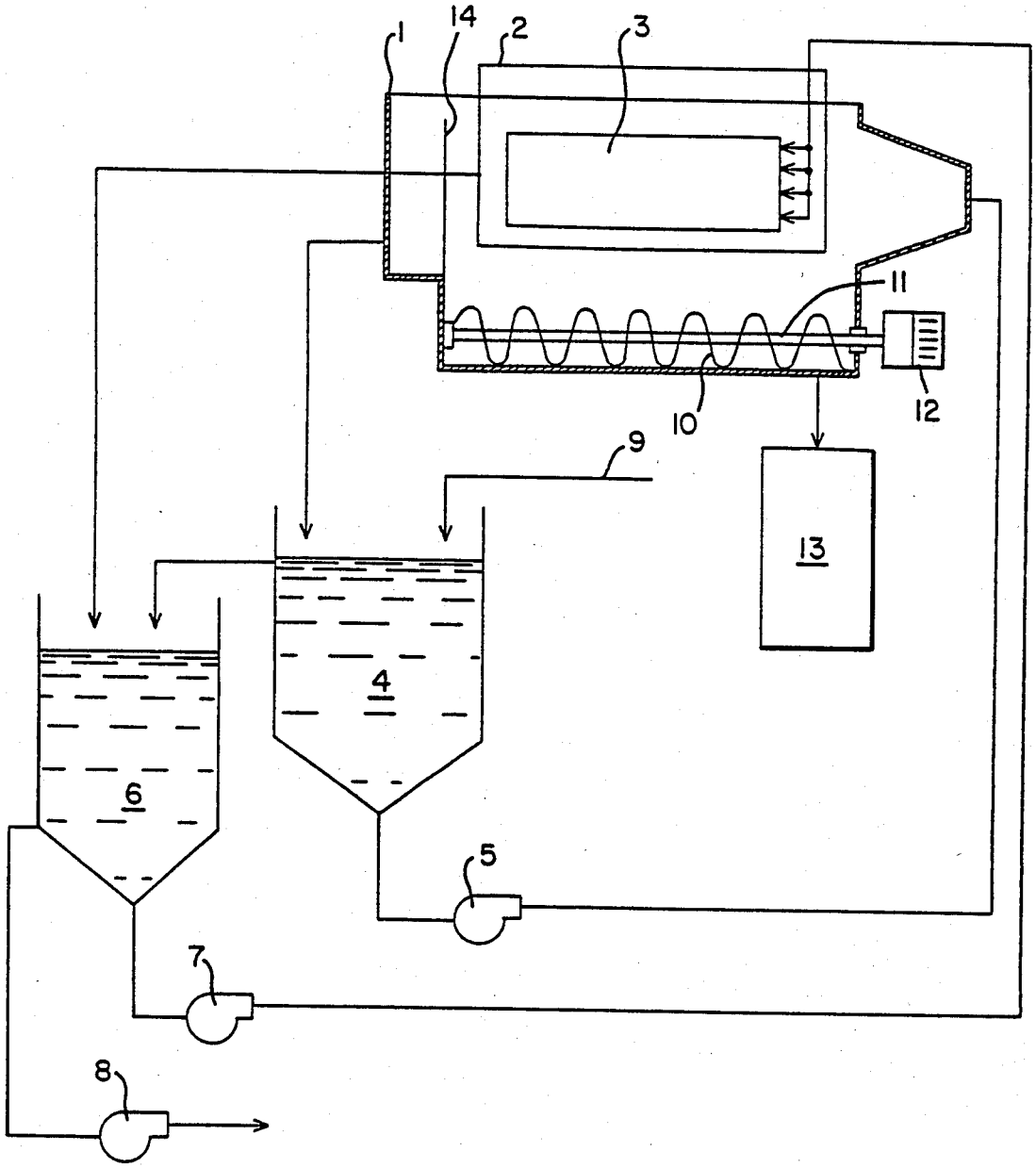
FIG. 1 is a schematic diagram of the apparatus utilized in the method of the present invention.

The different parameters which influence the application of the process will now be considered in more detail, first of all in the case where the beginning solution contains iron in the form of chloride, in addition to lead.

The solution which composes the electrolyte contains lead chlorides, alkali or earth-alkali metal chlorides, iron chlorides and possible chlorides of other metals, for example zinc.

The solution of lead chloride is advantageously formed from a concentrate of sulphurated lead ore which, in addition to lead, contains small amounts of zinc, copper, iron, calcium, and magnesium. After purification, for example according to the techniques described in French Pat. Nos. 2.323.766, 2.359.211 and 2.387.293 and in the request for European Pat. No. 0024987, the solution contains practically nothing but lead and iron, with the other metals being in negligible quantities. Said patents or patent request are incorporated into the present description.

The amount of lead in the form of chloride, present in the electrolyte, is preferably higher than 5 grams per liter but is preferably does not go higher than 50 grams per liter. These two values are determined according to the densities of current used in the course of electrolysis and the speeds of circulation of the electrolyte in the neighborhood of the electrodes, so that the faradic return and the production capacity are optimal.

The electrolyte contains also, in strong concentration, an alkali or earth-alkali chloride. The most advantageous is sodium chloride, for reasons of cost and availability. The quantity of this chloride in solution is advantageously chosen so that the concentration in chloride ion is higher than 3 gram-equivalents (i.e. in the case of sodium approximately 200 grams per liter), preferably between 4 and 5 gram equivalent (i.e. for sodium chloride between 230 and 300 grams per liter). The role of this chloride is to increase the concentration of chloride ions in the electrolyte, which permits the dissolution of the metals whose chlorinated complexes are soluble, and to reduce the losses because of the Joule effect.

In the method of application considered here, the electrolyte contains also some iron under the form of chloride. In the absence of iron, the chloride ions oxidize at the anode into gaseous chlorine with an electrode potential of 1.2 V in relation to the electrode of saturated mercurous chloride (calomel) (ECS). The device must include therefore a convenient collecting system. When it is not desirable that chlorine detach itself, the electrolyte contains advantageously some iron so that, at the anode, the ferrous ion is oxidized into ferric ion potential around 0.6 V/ECS. It is thus necessary that the electrolyte contain some iron in the form of ferrous iron. Not only does the chlorine no longer disengage at the anode, but the energy return is clearly increased. In addition, the ferric chloride formed at the anode is recovered and can be used again for the treatment of sulphurated lead ores and the transformation of the galena into elementary sulphur and into lead chloride.

The concentration of iron in the electrolyte, under the form of chloride, is preferably between 20 and 60 grams per liter, and advantageously it is on the order of 40 grams per liter. It is important that this concentration be at least equal to 20 grams per liter in the anode electrolyte, i.e. at proximity to the anodes.

Table I which follows shows the main characteristics of the composition of the electrolyte.

TABLE I

| | Useful region | Optimal conditions |
|---|---|---|
| Acidity, pH | 1–2 | 1 |
| Concentrations, g/l | | |
| sodium chloride | 230–300 | 250 |
| iron (Fe±±/Fe±±±) in chloride form | 20–60 | 40 |
| lead in chloride form | 5–50 | 15–25 |
| Zinc in chloride form | 0–20 | |
| Ferrous iron in chloride form in the anode electrolyte | 20 | 20–30 |

The nature of the electrodes used and especially of the cathodes is important for the application of the invention. One notes in fact that many materials are too "active", i.e. form sites of nucleation in too great a number. Consequently, particles of lead begin to form at an excessively large number of places on the surface of the cathodes and cannot grow individually. For this reason, it is essential according to the invention that the density of sites of nucleation, in the conditions of electrolysis used, be sufficiently low for the particles to be able to reach a dimension of at least 100 micrometers without sticking to adjacent particles. Preferably, the particles keep their individuality until they reach a dimension of at least 600 micrometers and preferably one millimeter. In these conditions, the particles individually have a surface sufficiently large so that, when the electrolyte moves the length of the surface of the cathode, it exercises a drawing force which, in combination with the force of weight, suffices to detach the particles when they have a size of several hundred micrometers.

This density of sites is important according to he invention because, if the number of sites is too large, the particles formed are small and numerous and, when they are later put into the air, they oxidize easily because they form a pyrophoric powder. On the contrary, if the density of sites of nucleations is too low, the production capacity is reduced.

One observes that one obtains a convenient density of nucleation sites by the use of cathodes whose surface is formed of smooth titanium. One can also use surfaces of stainless steel or graphite. Of course, one can also use other materials, when these have the suitable density of sites of nucleation. This density can be obtained by a treatment of activation or, most often, of deactivation according to the known technical techniques.

The anodes can be formed of graphite. However, as it is desirable that the transport of the material be facilitated, it is preferable that the anodes be formed of a spread out metal, for example, ruthenized titanium. However, the nature of the anode has much less importance for the application of the process of the invention than that of the cathode.

Obtaining high faradic returns requires mastery of the transport of ferric iron formed at the anode toward the cathode electrolyte. The choice of a suitable diaphragm, having a weak permeability, the use of a high density current and the maintenance of a difference in hydrostatic pressure between the cathode electrolyte and the anode electrolyte (this difference in pressure being at least 20 millimeters of liquid column) permit the avoidance if the passage of Fe III toward the cathode electrolyte. In this way, the entirety in practice of delivery of supplies of the cell passes across the diaphragm. This is advantageously formed of chemically inert textile fibers in the electrolyte. Materials which are suitable are polyester covered with silicon, teflon covered glass fibers, and preferably synthetic fibers of a base of polymers containing fluorine.

The phenomena of transport of materials in the course of electrolysis have an overriding importance on the morphology of the particles formed and on the faradic return thereby obtained. It has already been noted that it was advantageous that the anodes be formed of a spread out metal, permitting a good transport of materials, by an effect similar to that of promoters of turbulence. However, this phenomenon of accentuation of turbulences is advantageously used only at the level of the anodes. It is preferable, for obtaining particles of suitable morphology, that the electrolyte current the length of the cathodes be of laminary type or at least weakly turbulent only, while ensuring a sufficient renewal of the electrolyte at the level of the cathodes. It is in fact important that the concentration of lead vary only weakly in the entire electrolyte. Obtaining a laminary or weakly turbulent flow at the level of the cathode depends not only on the nature of the surface of the cathodes but also on the speed of the liquid the length of the cathodes. It is therefore desirable, according to the invention, that the linear speed of the cathode electrolyte, parallel to the cathodes, be at least 0.01 meter per second and preferably between 0.01 and 0.15 meter per second. At the level of the anodes, the speed of circulation of the solution which can be nil, is preferably at least 0.01 meter per second; the maximum value can be moderated, for example 0.05 meter per second, given the form of the anodes which favors the creation of turbulences.

The temperature of the electrolyte is advantageously put between 70° and 95° C., preferably between 70° and 90° C. No heating is necessary because the normal losses by the Joule effect suffice to maintain the temperature in the mentioned range.

The application of the process of the invention permits the use of current densities which are very high. They can be between 500 and 1,500 A/m$^2$. Preferably, they are included between 700 and 1,000 A/m$^2$.

Table II summarizes the various conditions cited above:

TABLE II

| | Useful range | Optimal conditions |
|---|---|---|
| Temperature, centigrade | 0–95 | 70–90 |
| Linear speed of circulation m/s | | |
| at the anode | 0.01 | 0.01–0.05 |
| at the cathode | 0.01 | 0.01–0.15 |
| Density of current A/m$^2$ | 500–1500 | 700–1000 |

It is desirable, at the time of the application of the process according to the invention, that the electrolysis begin at a weak density of current, lower than the values indicated above, and grow progressively up to the chosen value, included in the mentioned range. In fact, when the solution contains ferrous chloride, the iron can deposit itself at the same time as the lead, on the cathodes, when the density of the current is initially very high. The metal adheres then on the entire surface of the cathodes, so that they no longer possess a density suitable for sites of nucleation.

When the electrolyte contains practically no iron chloride, the initial use of a high density of current can produce the disengagement of hydrogen whose bubbles have a tendency to stick to metallic particles so that the latter, instead of falling to the bottom of the electrolysis cell, have a tendency to float.

The period during which the density of current increases progressively or by steps, up to the final desired value, is advantageously several hours.

As indicated above, it has been noted that it was desirable that the product obtained be under the form of individual particles having a dimension of several hundreds of micrometers, for example 300 to 600 micrometers. Their form can be spreading and relatively flat, but their surface is relatively weak for their volume. It is this characteristic which gives to the particles formed their non pyrophoric character.

The particles are formed of very pure lead. For example, metals such as zinc, copper, cadmium, magnesium, etc. are present in a quantity lower than 1 ppm in weight. The amount of iron is lower than several ppm in weight. Therefore, lead which requires no later refining at all is produced for most applications. The examples which follow give the purity of lead obtained in different conditions.

One important parameter for the application of an electrolysis is the faradic return obtained since this shows the importance of electric losses. According to the invention, this faradic return is at least equal to 90% and it reaches and exceeds in general 95%. Of course, these returns are obtained only when the different parameters have the desired values, corresponding for example to the tables cited previously i.e. Tables I and II.

The particles of lead which are deposited on the bottom of the cell are then extracted, with the aid of a suitable device, as indicated herein reference to an apparatus designed for the application of the process according to the invention. The particles of lead, when they are withdrawn, are associated with the occluded electrolyte, present in an amount between 20 and 30% in weight, approximately. It is thus desirable that the material undergo a compacting process or lamination. It is in particular desirable that the particles be thickened by extrusion, in a piston or roller press, exercising pressures higher than approximately 70 MPa. The filtration of the product is scarcely desirable given that the smallest particles run the risk of partially oxidizing in the air.

When the particles are removed from the bottom of the vat, they have an apparent density on the order of 1.5 to 2.0. After extrusion, this density surpasses 10.5. The lead by-product thereby obtained, for example in the form of foil, is stable vis-a-vis oxidation by the air. It can be used "as is" in certain applications.

In a variant, the lead can undergo fusion in the presence of solder, according to a well-known technique.

The description which precedes concerns the electrolysis of a solution containing ferrous chloride. This characteristic is not indispensible. When the process is applied without ferrous chloride in the electrolyte, it removes some chloride at the level of the anodes. The device used must thus include a collecting system for chlorine. Such systems are well known in the electrochemical industry and they are therefore not described in detail here.

The density of the current can then have an increased value, between 800 and 2,000 A/m$^2$, preferably between 800 and 1,200 A/m$^2$.

The pH of the electrolyte is at an equilibrium value between 1.2 and 1.7, at a temperature from 70° to 80° C. This pH depends on the concentration of sulphate ions and on the density of the current. It may be advantageous, however, to work at a pH ranging from 2 to 3, so as to prevent the reactions of electrolysis of the proton, in order to produce hydrogen. In this case, it is therefore necessary to provide a system for the adjustment of the pH by means of adding a base that is, by preference, chosen, in such a way as not to add foreign ions to the electrolytes. One would make use by preference of the basic compounds of sodium (soda, sodium carbonate, or even basic compounds of lead, hydroxide of lead, lead monoxide, basic lead carbonate, etc.).

Besides, the different parameters considered above must have mainly the same values. They are therefore not described in detail.

Although the process has been described in reference to the deposit of lead, it is not limited to this single metal. In fact, the process also permits the formation of particles of copper, in similar conditions and especially with cooper chloride.

Another object of the present invention consists in providing a device containing numerous pairs of anodes and cathodes that have been arranged, in such a way that they are not isopotential. As a matter of fact, the method which has been explained above, implies the use of numerous pumps for recycling. Numerous pumps cause investment costs that may be considerable. That is the reason why we have striven to perfect a device for electrolysis that will make it possible to reduce the number of pumps for the recycling of the electrolytes, and that, in a general way, will reduce the investment cost of electrolysis devices. Non-isopotential devices, that are derived from those that have already been put into operation for the electro refining of copper in a sulfate medium, may be used. We may make reference to the "Mining Annual Review 1982", page 282, as well as to the article "Technologically Advanced Smelter Incorporates Latest Design Concepts", Journal of Metals, July 1979, pages 16 to 26. The electrolysis tank mentioned above and commonly called "tank-bath" is equipped with a series of generally parallel rows, between which electrolytic cells are arranged. Each cell consists of a couple formed by an anodic surface and a cathodic surface. Each anode and each cathode—except those at the end of each row—belong to two cells. In one and the same row, all the cells have been mounted parallel in the form of a comb (or of a rake), i.e. that all the anodes of one and the same row are of the same voltage, while all the cathodes of one and the same row are, likewise, of the same voltage. The rows of said electrolytic tank-bath have been mounted in electric series. For that reason, there is a voltage gradient in the tank-bath. But a technology of that type can be used for the electroplating and refining of copper only because of the very small voltage differential between anode and cathode, viz. of the order of 0.25 V; and even so, it is necessary that the distance separating two rows amount to approximately 0.5 m; if that is not the case, the energy losses due to the parasitic current and/or leakage from one cell to another will be considerable.

That is the reason why the devices described in the articles mentioned above had to be thoroughly modified, in order to be adapted to the methods in accordance with the invention, so as to minimize the leakage currents and the various energy losses caused by those leakage currents.

The cathodes of two different rows, situated within the same plane, are separated by insulating partitions of non-conductive material, and when one forms "anodic channels" by interconnecting the anodic boxes by means of a non-conductive material, in such a way that the anode electrolyte is separated from the cathode electrolyte, it is possible to realize these non-equipotential means, in such a way that the energy losses will not be too high as long as the distance separating two rows of electrodes is comprised between 0.8 and 2 m and, by preference, between 1.0 and 1.5 m. the isolating partitions have, by and large, the same height as the electrodes.

Conditions such as the ones described in Examples 6 and 7 make it possible to achieve excellent results.

Accordingly, the present invention, which one may call a "tank-canal", consists of a series of rows of anodes and cathodes mounted in parallel, wherein the anodes of each row are staggered, so as to be parallel to one another, by a distance of 5 to 20 cm in the direction of the decreasing voltages of the electrolysis tank, while the distance between two rows ranges from 0.8 to 2.0 m. The cathodes of the various rows located within the same plane are interconnected by means of partitions that consist of insulating material, in order to limit parasitic currents or leakages. Even though this is less important, the anodes of the various rows, situated within one and the same anodic channel, may be interconnected by means of partitions consisting of insulating material, in such a way as to limit parasitic currents and/or leakages.

The whole forms a juxtaposition of channels that are parallel to one another and vertical to the rows of electrodes.

Pump systems similar to the ones that have been described in the present Application, enforce a circulation of cathode electrolyte and anode electrolyte between each cathode and each anode, separated by the diaphragm that has been described above in the description of the method. A device of this type can be used not only for starting the operation of the present invention, but also in any device for electrolysis in which a forced circulation of the electrolytes is desired.

The characteristics of a device designed for the application of the process of the invention will now be considered. The characteristics of the cathodes and the anodes, which have already been specified, will not be considered again. The device can be of monopolar or bipolar type. The bipolar arrangement has some advantages because it reduces the losses of energy by reduction of the omhic declines in the electrodes, and in the afferent members; it reduces the cost of the electrodes since they have a double role, and it simplifies the arrangement of all of the electrodes, while permitting a better energy return. This advantageous arrangement however poses certain problems of configuration at the ends of the electrodes, especially for avoiding flight currents, as is well known to specialists in this field.

FIG. 1 in the attached drawing is a design of an example of an apparatus designed for the application of the process according to the invention.

In the figures, 1 refers to an electrolysis vat containing an anodic box 2. The diaphragm is represented by 3.

The circuit of circulation of the cathode electrolyte includes a reservoir 4, and a pump 5, for circulation. The cathode electrolyte circulates parallel to the plane of the cathodes which are mounted in the vat 1.

The circuit of the anode electrolyte includes a reservoir 6, and a pump 7, which makes the anode electrolyte circulate.

Pump 8 is designed to extract a part of the anode electrolyte which is concentrated as ferric chloride and is suited for the treatment of sulphurated lead ores. The solution of supply 9, returns to the cathode electrolyte the suitable composition in the reservoir 4. The particles which detach themselves from the cathodes fall to the bottom of the cell and are taken up by an endless screw 10, mounted on a trunk 11, driven in rotation by a motor 12. The particles arriving at the end of the screw enter a receptacle 13, and are then treated as described above.

In the apparatus represented schematically in the figure, the nature of the electrodes and their arrangement are such as described above. The diaphragm and the anodes also have properties indicated above. When the solution contains no ferrous chloride, a collecting hood must be mounted above the anodes so that it gathers the chlorine which is produced.

The adjustment of the overflow makes it possible to maintain a difference of the level between cathode electrolyte and anode electrolyte as indicated above. The flows of the pumps 5 and 7 are regulated, in such a way that the speeds of the anode electrolyte and the cathode electrolyte, the length of the anodes and the cathodes, have the values shown before, i.e., at least equal to 0.01 meter per second. The flow which crosses the diaphragm is practically equal to the flow of the supply solution. In this manner, the ferric iron can not practically pass into the cathode electrolyte.

The cell has, preferably, a trapezoidal bottom, or rounded bottom so that the particles which fall may be guided toward the endless screw.

Although the figure represents an endless screw driven by a motor, other mechanisms are also suitable. For example, elevators with cups or movable belts may also be used advantageously. The product may also pass into an extruder where it is preliminarly thickened, up to a density from 3 to 6. The extruder may also be equipped with a drawplate wide enough to ensure watertightness.

According to the preferred application of the invention, the metallic particles formed are recovered with the help of a gooseneck operating discontinuously. In this case, one gives the bottom of the cell a pyramidal type shape in order to direct the lead particles toward a gooseneck which mounts vertically the length of the cell. The liquid level in the gooseneck is in hydrostatic equilibrium with that of the cell of electrolysis, i.e. the throwing-out point of the gooseneck is located from 2 to 20 centimeters above the level of the surface of the cathode electrolyte: the aggregates of lead accumulate in the lower part of the gooseneck, composing a veritable cork; intermittently one or several ejectors, which may be carried out by discharge pipes, are fed by some cathode electrolyte, without solid matter, at a flow sufficiently great to create in effect a suction at the bottom of the cell and to reach a linear speed of flow of the liquid in the gooseneck of at least 0.5 meter per second. The lead is led away and recovered after separation of the liquid in an appropriate system which is disconnected hydraulically from the electrolysis cell.

One may also carry away the agglomerates of lead by air-lift. The ejector(s) are arranged under the gooseneck at appropriate places known to those skilled in this field, to obtain a good effect of suction or air-lift.

The following examples of carrying out the present invention, though not exhaustive, have the purpose of letting specialists determine easily the operating conditions which are suitable to use in each specific case.

EXAMPLE 1

One treats by a solution of ferric chloride and of sodium a sulphurated raw material composed of a concentrate of galena, containing 75.5% lead, 0.70% zinc, 0.85% copper, 1.40% iron, 1.0% calcium, and 0.6% magnesium.

After purification, the feeding solution of the electrolyser and the electrolyte have the following compositions:

| Elements | Na g/l | Pb g/l | Fe g/l | Cu mg/l | Ag mg/l | Ni mg/l |
|---|---|---|---|---|---|---|
| Feeding Solution | 100 | 47 | 35 | 0.2 | 0.1 | 0.5 |
| Electrolyte | 100 | 20 | 35 | 0.2 | 0.1 | 0.5 |

Electrolysis is carried out in an installation of the type shown in the figure; the speed of circulation of the cathode electrolyte is 0.06 meter per second and that of the anode electrolyte 0.01 meter per second. The cathodes are formed of smooth titanium. The density of current, as a rule is 550 A/m$^2$. The distance separating the electrodes is 70 millimeters.

One observes that the lead obtained is in the form of particles having a length on the order of 300 to 600 macrometers and does not adhere to the cathodes. The faradic return observed is 95%, and the energy return is 0.57 kWh per kilo of lead.

The purity of the lead obtained on the one hand in simple laminated form, and in the form of an ingot is as follows:

| Elements | Na g/l | Pb g/l | Fe g/l | Cu mg/l | Ag mg/l | Ni mg/l |
|---|---|---|---|---|---|---|
| Supply Solution | 100 | 47 | 35 | 0.2 | 0.1 | 0.5 |
| Electrolyte | 100 | 20 | 35 | 0.2 | 0.1 | 0.5 |

Electrolysis is carried out in an installation of the kind represented in the figure; the speed of circulation of the cathode electrolyte is 0.06 meter per second and that of the anode electrolyte 0.01 meter per second. The cathodes are formed of smooth titanium. The density of current, as a general rule, is 550 A/m$^2$. The distance separating the electrodes is 70 millimeters.

One observes that the lead obtained is under the form of particles having a length on the order of 300 to 600 micrometers and does not adhere to the cathodes. The faradic return observed is 95% and the energy return is 0.57 kWH per kilo of lead.

The purity of lead obtained in the laminated, form and in the form of an ingot is as follows:

| Element (ppm) | Na | Fe | Cl— | Cu | Ag | Ni | Cd | As | Sn | Bi |
|---|---|---|---|---|---|---|---|---|---|---|
| Laminated | 120 | 159 | 2000 | 2 | 2 | 7.0 | | | | |
| Ingot | 10 | 5 | 30 | 2 | 5 | 7.0 | 5 | 15 | 20 | 5 |

EXAMPLE 2

One uses the same installation and an electrolyte of the same composition as in example 1. The speed of circulation of the cathode electrolyte is 0.10 meter per second and that of the anode electrolyte 0.02 meter per second. The density of current used is 850 A/m$^2$ and the distance between the electrodes is the same as in example 1.

The lead produced is similar to that described in example 1. The energy return of the electrolysis is 0.74 kWh per kilo.

EXAMPLE 3

One uses an installation similar to that of example 1. The cathodes are formed of smooth titanium and the anodes of spread out titanium covered with ruthenium oxide. The distance which separates them is equal to 70 millimeters. The anodes are arranged in an anodic box in which the anode electrolyte does not circulate. The difference in pressure between the anode electrolyte and the cathode electrolyte is 20 millimeters of a column of water. The installation is designed to permit the recovery of chlorine.

In this example, the density in lead of the electrolyte is maintained by the continuous introduction of crystallized lead chloride. The crystals contain the following impurities, expressed in grams per ton:

| | | | | | |
|---|---|---|---|---|---|
| Fe: | 15 | Ni: | 1 | Mg: | 4.4 |

-continued

| | | | | | |
|---|---|---|---|---|---|
| Na: | 10–50 | Zn: | 4.0 | Ca: | 5.0 |
| Cu: | 2.5 | Cd: | 5 | | |
| Ag: | 1 | S: | 40 | | |

The conditions of electrolysis are the following:
density of current: 1,000 A/m$^2$
temperature: 75° C.
linear speed of the cathode electrolyte: 0.04 meter per second.

The energy return of the electrolysis is 1 kWh per kilo of lead. The lead particles form a powder of apparent density between 1.5 and 2.5 and contain 20 to 30% in weight of occluded electrolyte. After thickening in the laminator, this electrolyte is extracted from the powder.

The table which follows shows not only the composition of the electrolyte but also the purity of the products obtained, on the one hand after thickening, and on the other hand after the formation of an ingot.

| | Electrolyte mg/l | Pb thickened g/t | Ingot of Pb g/t |
|---|---|---|---|
| Na | 98,000 | 100 | 30 |
| $SO_4$ | 10 | — | — |
| Mg | 14 | 1 | 1 |
| Ca | 40 | 1 | 1 |
| Cd | 0.5 | 2 | 2 |
| Cu | 0.7 | 1 | 1 |
| Zn | 8 | 2 | 2 |
| Fe | 16 | 3 | 3–10 |
| Ag | 0.5 | — | — |
| Ni | 0.7 | 1 | 1–3 |

EXAMPLE 4

The operating conditions are identical to those of example 3, but the electrolyte contains 10 grams per liter of sulphate. At this concentration, the electrolysis is not disturbed by the sulphate ions and the energy return remains mainly equal to 1 kWh per kilo of deposited lead.

The lead particles obtained have the same purity and the same rate of occluded electrolyte as in example 3.

EXAMPLE 5

One uses operating conditions identical to those of example 4, but one carries the density of current to 1,500 A/m$^2$.

The energy return reaches 1.24 kWh per kilo of lead deposited. The purity of lead particles obtained and the characteristics before thickening remain the same as in the preceding example.

EXAMPLE 6

Electrodes of the same type of electric series are mounted in the same tank to prepare an electrolytic laboratory cell that is 2 m long, 0.15 m high, and 0.03 m wide. The amount of the leakage currents between two cells has been evaluated. Each cell consists of one anode and one cathode. Electrolysis of copper sulfate has been chosen, so as to facilitate the measures that essentially pertain to the evolution of leakage currents, and to the distribution of the density of leakage currents, and to the distribution of the density of the current on the surface of the cathodes.

As a matter of fact, in a sulfate medium, the deposits of copper are compact and the faradic yield of the deposits is very close to the unit within a range of density of the current ranging from 200 to 300 amp per m$^2$.

Under those conditions, it is possible, by cutting the deposit again into bands of equal length, to determine, on the basis of the weight of each band, the average current density of electrolysis on each surface element, and to find, in that way, the profile of distribution of the average current density over the surface of the cathode.

Figure 2:
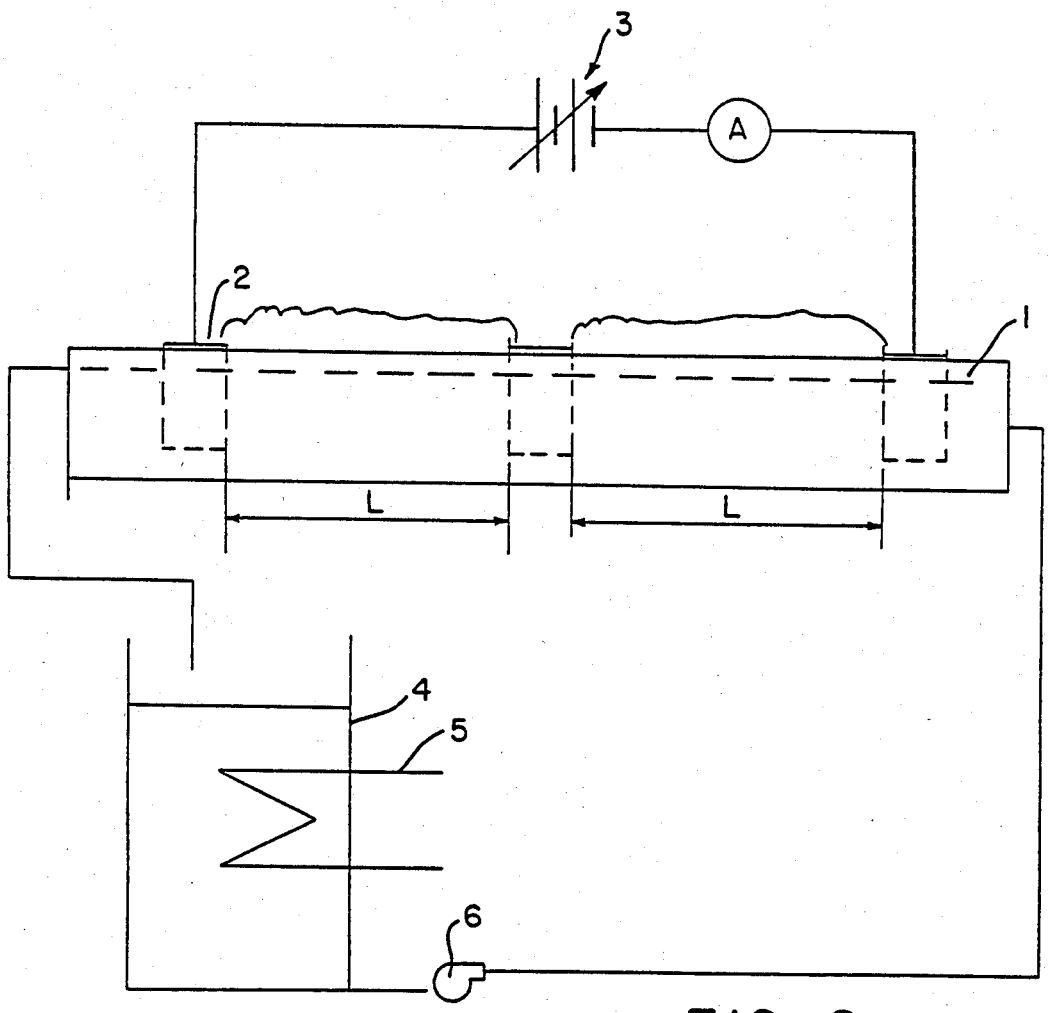
FIG. 2 is a schematic diagram of the apparatus utilized in the method of example 6 of the specification.

FIG. 2 shows the experimental set-up used. The solution of copper sulfate is kept in circulation between the supply tank 4, the means of heating 5, and the electrolysis tank of the canal type 1 by means of the centrifugal pump 6.

Each cell consists of a lead anode and of a stainless steel cathode, which are mounted at a distance of 1.6 cm. In the tank 1, one, two, or three cells may be mounted in electric series, and the distance from one cell to the other may vary.

Figure 3:
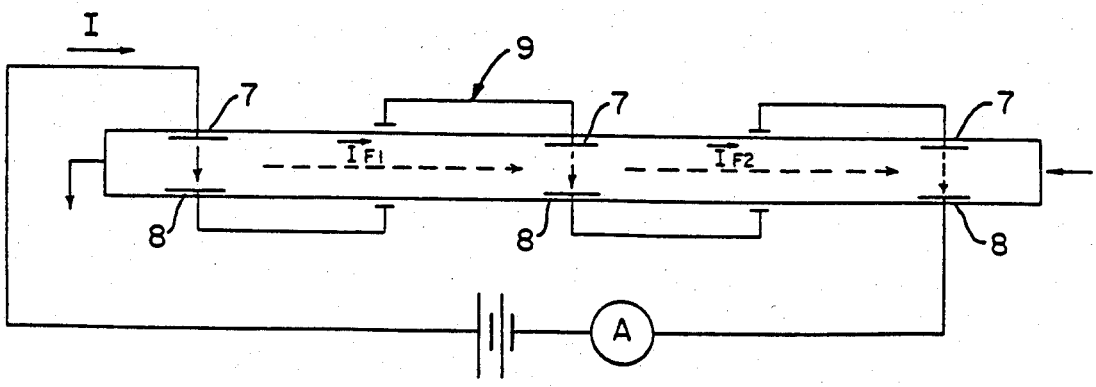
FIG. 3 is a schematic diagram of the electric connections between the anodes and cathodes shown in FIG. 1.

The schematic drawing of FIG. 3 shows mainly the electric connections between the anodes 7 and the cathodes 8. Each cell 2 is connected externally by means of a conductor 9. There exists between each cell 2 a leakage current 1 F that reduces the overall energy yield of the electrolyser, and that disturbs the distribution of the current density on the edges of the electrodes, mainly between the anode of one cell and the cathode of the adjoining cell.

In the following Table, the most important results achieved by an electrolyte that contains 40 g of copper per liter and 165 g of sulfuric acid per liter. All the tests have been conducted at a temperature of 40° C. over periods of 15 to 20 hours.

| Test | Distance Between Cell L (M) | Intensity (A) | Amount Of Electricity | Leakage Current 1 F |
|---|---|---|---|---|
| 1 | 0.25 | 1 | 54,374 | 0.66 |
| 2 | 0.50 | 1 | 23,190 | 0.38 |
| 3 | 0.75 | 1 | 58,951 | 0.32 |
| 4 | 0.55 | 1 | 60,943 | 0.19 |
| 5 | 0.55 | 1.5 | 29,980 | 0.22 |

Figures 4A, 4B:
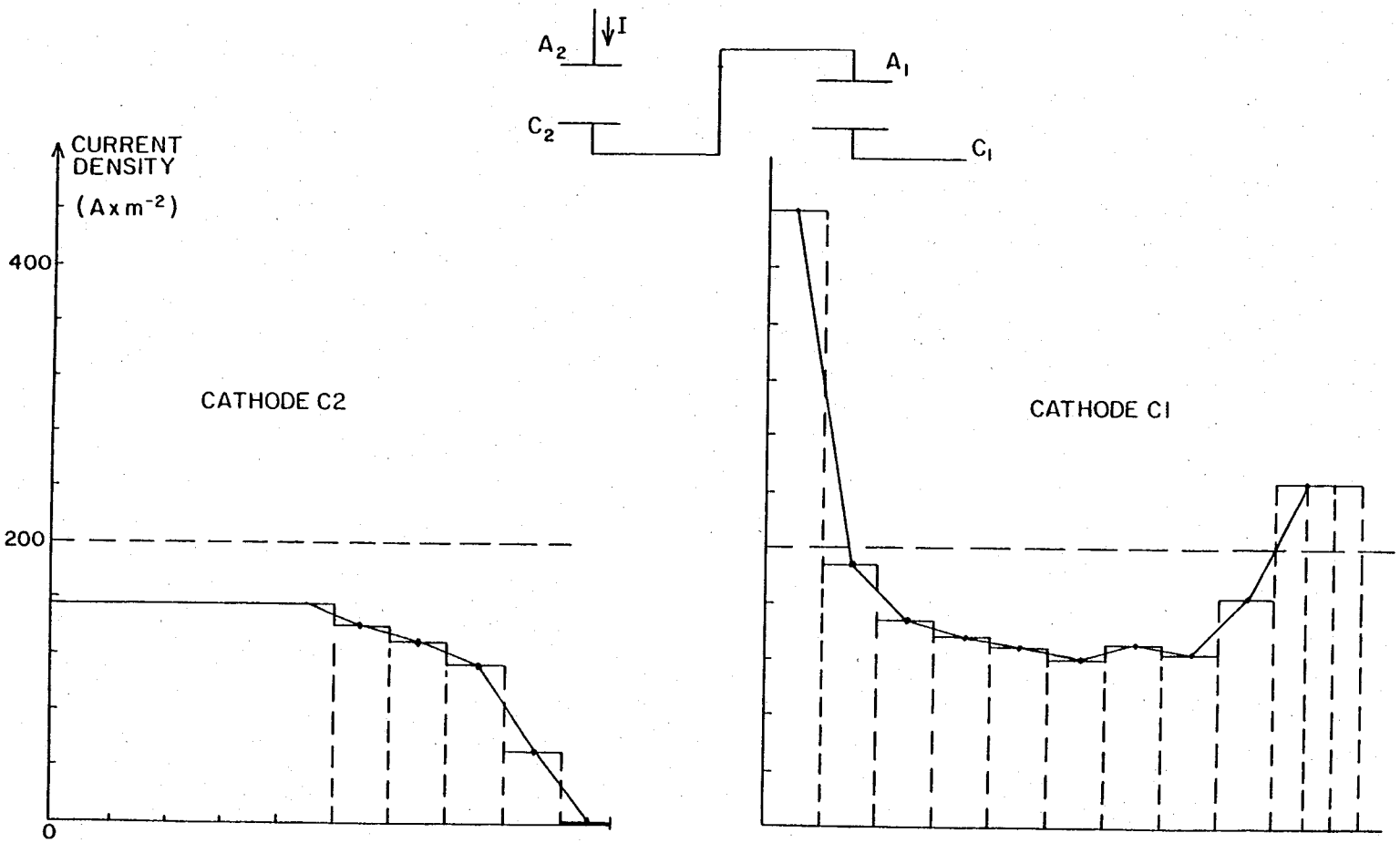
FIGS. 4A and 4B are graphs showing the mean density obtained on the cathodes for test 2 of the specification.
Figure 5:
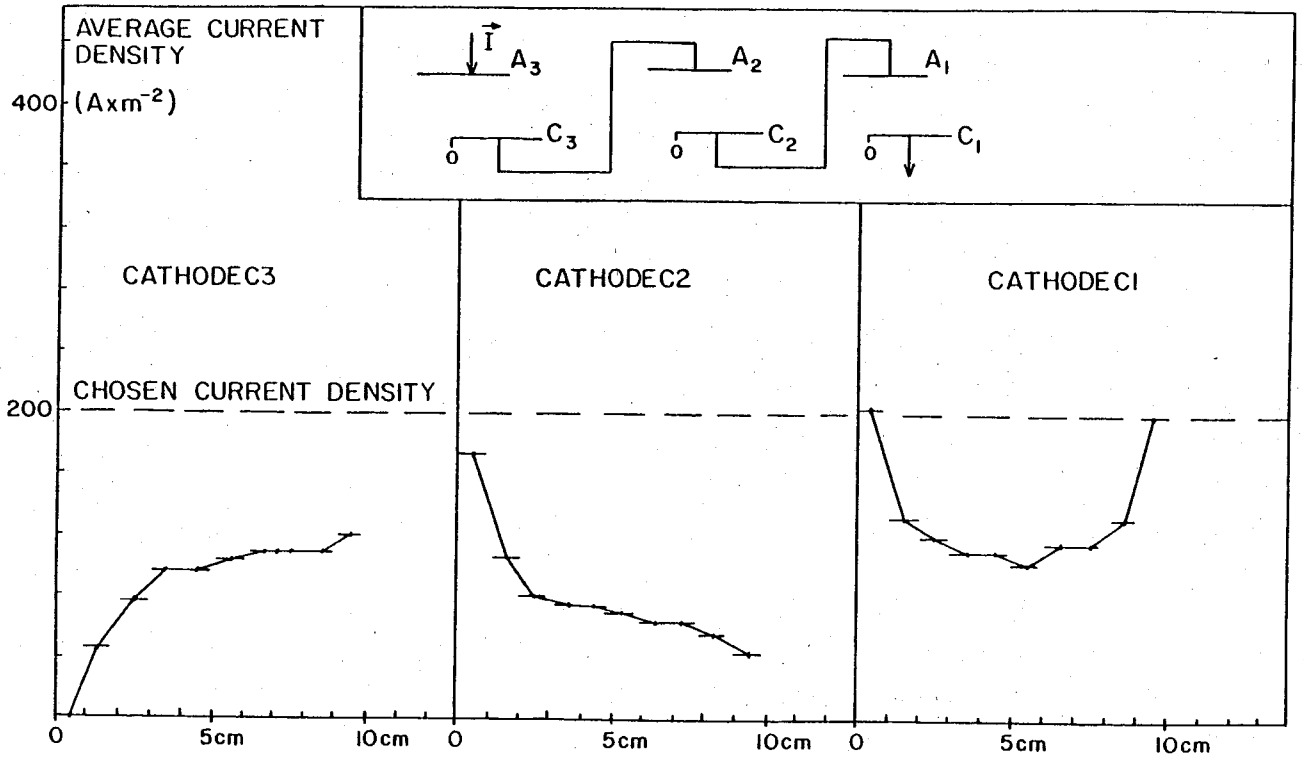
FIG. 5 represents the profiles of the true density distribution of the current on the cathodes when the electrodes are placed in a staggered position in the cells.
Figure 6:
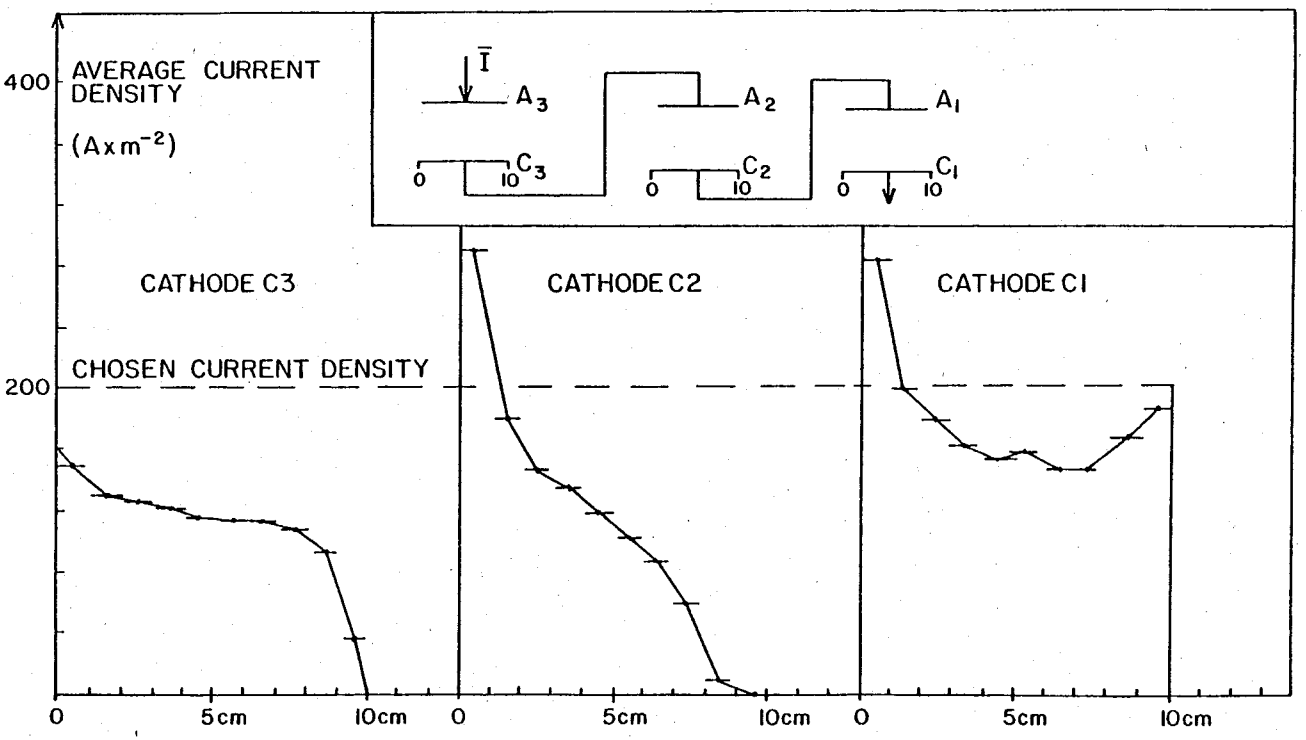
FIG. 6 represents the profiles of the true density distribution of the current on the cathodes when the electrodes are placed in a non-staggered position in the cells.

On a small scale, the leakage current represents a relatively important value in relation to the intensity of the current supplied by the rectifier. Relative importance of the leakage current will be reduced considerably on a larger scale. FIGS. 4A and 4B present, by way of an example, the profile of the mean density as obtained on the cathodes 8 for test 2.

EXAMPLE 7

The excessive density of the current on the edges of the cathodes is not acceptable because of the increase in the local excess voltage of the electrode that carries the risk of causing the appearance of parasitic reactions.

The disadvantage has been alleviated by means of staggering the vertical axes of the anodes and of the cathodes of each cell, and by the use of a current strength taking into account the density of the current chosen and of the electrode surfaces opposite. The aim is the capability of ensuring a true current density on the surface of the cathodes that is lower than the density of the current chosen. This type of assembly has been tested with the experimental set-up as described above.

In the following Table, we have shown the comparative results of the two electric assemblies consisting of three cells placed at distances of 0.63 m from one another; one assembly comprises the staggered electrodes, and the other assembly shows the electrodes in each cell non-staggered.

The following figures represent the profiles of the true density distribution of the current on the cathodes with or without staggering.

| Test | No. of cell | Space between 2 cells L (M) | Electrode surface DM2 | Staggering (MM) | Int. (A) | Leak amp 1F1 | 1F2 |
|---|---|---|---|---|---|---|---|
| 6 | 3 | 0.63 | 0.72 | 0 | 1.44 | 0.49 | 0.48 |
| 7 | 3 | 0.63 | 0.72 | 25 | 1.08 | 0.49 | 0.46 |

What is claimed is:

1. Apparatus for the preparation of metal by electrolysis comprising pump means for supplying electrolyte to a cell;

a cell having a diaphragm, an anode and a planar surface cathode;

said cathode being formed of a material selected from the group consisting of titanium, stainless steel and graphite with said material having a density of nucleation sites such that metallic particles formed thereon obtain a size of at least 100 micrometers without sticking to adjacent metallic particles;

said cathode being vertically disposed in said apparatus and cooperating therewith so that electrolyte is caused to flow parallel to and along the length of said planar surfaces;

said pump circulating the electrolyte at a laminar to weakly turbulent flow rate so that the flow of electrolyte and the weight of said metallic particles of said size enables said particles to be dislodged from said cathode and fall to the bottom of the cell; and means for withdrawing the solid particles from the bottom of said cell.

2. Apparatus according to claim 1 wherein said means for withdrawing includes a gooseneck cooperating with the bottom of said cell.

3. Apparatus according to claim 2 wherein said means for withdrawing includes an endless screw.

4. Apparatus according to claim 3 wherein said means for withdrawing includes an elevator with cups supported by a moving band.

5. Apparatus according to claim 4 which further includes an extruder to thicken materials removed by said withdrawing means.

6. Apparatus in accordance with claim 5, wherein the anodes are staggered in relation to the cathodes at a distance between 5 and 20 cm, said staggering being effected in the sense of the decreasing voltages in the electrolyte tank.

7. Apparatus according to claim 3 which further includes an extruder to thicken materials removed by said withdrawing means.

8. Apparatus according to claim 2 which further includes an extruder to thicken materials removed by a transporting means.

9. Apparatus according to claim 1 wherein said density of nucleation sites is sufficiently low such that said size is between about 100 micrometers and 1 millimeter.

10. The apparatus according to claim 1 which includes bipolar electrodes.

11. Apparatus according to claim 1 wherein said anode is formed of a spread out metal.

12. Apparatus according to claim 1 wherein a gas recovery hood is associated with said apparatus to recover any gaseous products of said electrolysis process.

13. Apparatus according to claim 1 wherein there are a plurality of cathodes and anodes.

14. The apparatus according to claim 13 wherein said anodes and cathodes are arranged to form a series of rows of anodes and cathodes connected with the same supply of current, wherein the electrodes of two different rows situated within a common plane are connected by means of partitions comprising a non-conductive material, and wherein the distance separating two rows of electrodes is between 0.8 and 2 m.

15. Apparatus for the preparation of metal by electrolysis comprising means for supplying electrolyte to a cell;

a cell with a diaphragm and a vertically extending planar surface cathode;

said cathode being formed of a material having a density of nucleation sites such that metallic particles formed thereon obtain a size of at least 100 micrometers adjacent metallic particles;

said cathode in said apparatus cooperating therewith so that electrolyte is caused to flow parallel to and along the length of said planar surface;

said means for supplying electrolyte circulating the electrolyte at a sufficient flow rate so that the flow of electrolyte dislodges said metallic particles of said size from said cathode whereby said metallic particles fall to the bottom of the cell; and means for withdrawing the solid particles from the bottom of said cell.

16. Apparatus according to claim 15 wherein said density of nucleation sites is sufficiently low such that said size is between about 100 micrometers and 1 millimeter.

17. Apparatus according to claim 15 wherein a gas recovery hood is associated with said apparatus to recover any gaseous products of said electrolysis process.

18. Apparatus according to claim 15 wherein said cell has an anode.

19. Apparatus according to claim 18 wherein there are a plurality of cathodes and anodes.

20. The apparatus according to claim 19 wherein said anodes and cathodes are arranged to form a series of rows of anodes and cathodes connected with the same supply of current, wherein the electrodes of two different rows situated within a common plane are connected by means of partitions comprising a non-conductive material, and wherein the distance separating two rows of electrodes is between 0.8 and 2 m.

21. Apparatus in accordance with claim 20 wherein the anodes are staggered in relation to the cathodes at a distance between 5 and 20 cm, said staggering being effected in the sense of the decreasing voltages in the electrolyte tank.

22. Apparatus according to claim 15 wherein said cathode is formed of a material selected from the group consisting of titanium, stainless steel and graphite.

* * * * *